US006434086B1

(12) United States Patent
Suzuki et al.

(10) Patent No.: US 6,434,086 B1
(45) Date of Patent: Aug. 13, 2002

(54) ANALOG ELECTRONIC TIMEPIECE

(75) Inventors: Kazuo Suzuki, Tokorozawa; Takayasu Machida, Iruma; Takanori Nanya, Sayama; Shigeyuki Takahashi, Kodaira; Takeaki Shimanouchi, Hannou, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/720,737

(22) PCT Filed: Jul. 2, 1999

(86) PCT No.: PCT/JP99/03599

§ 371 (c)(1),
(2), (4) Date: Dec. 29, 2000

(87) PCT Pub. No.: WO00/02099

PCT Pub. Date: Jan. 13, 2000

(30) Foreign Application Priority Data

Jul. 3, 1998 (JP) ..... 10-188413
Jul. 3, 1998 (JP) ..... 10-188414

(51) Int. Cl.[7] ..... G04B 13/02
(52) U.S. Cl. ..... 368/220; 368/322
(58) Field of Search ..... 368/76, 80, 220, 368/322, 323

(56) References Cited

U.S. PATENT DOCUMENTS 4,308,610 A * 12/1981 Walker ..... 368/220
5,096,193 A 3/1992 Lee

FOREIGN PATENT DOCUMENTS

| | | |
|---|---|---|
| JP | 55-55773 | 4/1980 |
| JP | 62-20391 | 2/1987 |
| JP | 7-159552 | 6/1995 |
| JP | 7-306744 | 11/1995 |
| WO | WO98/30939 | 7/1998 |

OTHER PUBLICATIONS

Yamada, Takehide, Wheels Series of Hand Type Portable Watch, Aug. 25, 1998, JP10227876, Abstract.*
Minamitani et al., Analog–Type Electronic Clock, Jan. 2000, JP200019269, Abstract.*

* cited by examiner

*Primary Examiner*—Vit Miska
*Assistant Examiner*—Jeanne-Marguerite Goodwin
(74) *Attorney, Agent, or Firm*—Armstrong, Westerman & Hattori, LLP

(57) ABSTRACT

In an analog electronic timepiece in which the rotation of a rotor (1a) step motor (1) is decelerated through train wheels before it is transmitted an hour hand (17) and a minute hand (15), the gravity center of a center wheel composed of a center wheel gear (9), a center wheel pinion (10), and a center wheel shaft (11) to which the minute hand (15) is mounted is displaced from the axis of the center wheel shaft (11) to within an angle range of less than ±90° with respect to the opposite direction to a direction in which a time indicating part (15a) of the minute hand (15) extends so as to reduce a moment on the center wheel shaft (11) caused by a combination of the minute hand (15) and the center wheel. This makes it possible to prevent a hand-skip due to disturbance even if the value of holding energy of the step motor (1) is reduced.

12 Claims, 11 Drawing Sheets

ANALOG ELECTRONIC TIMEPIECE

TECHNICAL FIELD

The present invention relates to an analog electronic timepiece for indicating the time by hands, more specifically, to a technology for reducing power consumption thereof.

BACKGROUND TECHNOLOGY

A timepiece is not only for telling the correct time, but also has as an aspect of an accessory. In almost all of timepieces, external visual design occupies an important position.

Almost all of the recent timepieces such as wristwatches are electronic timepieces using quartz oscillators, which are of a digital type of indicating the time by numbers and an analog type of indicating the time by a dial and hands. In the analog electronic timepiece, the following two functions are required to be satisfied at the same time.

One of them is a function of rotating hands only fixed angles in a set period of time, and the other is a function of holding the hands to prevent occurrence of a hand-skip phenomenon against an external impact.

FIG. 19 is an expanded view showing the structure of train wheels in a driving part of a conventional analog two-hand electronic timepiece, and also shows concentric and coaxial gears expanded.

The rotation of a rotor 1*a* of a step motor is transmitted through a rotor pinion 2 to a fifth wheel gear 3, and through a fifth wheel pinion 4 rotating integrally with the fifth wheel gear 3 to a second wheel gear 5. Further, the rotation of the second wheel gear 5 is transmitted through a second wheel pinion 6 to a third wheel gear 7 and transmitted through a third wheel pinion 8 to a center wheel gear 9 to rotate a minute hand 15 which is mounted on the center wheel gear 9 via a center wheel shaft.

Furthermore, the rotation of the center wheel gear 9 is transmitted through a center wheel pinion 10 to a minute wheel gear 12 and transmitted through a minute wheel pinion 13 to an hour wheel 14, whereby the rotation is transmitted to an hour hand 17 mounted on the hour wheel 14. In other words, the rotational motion is bidirectionally transmitted through a train wheel mechanism from the rotor 1*a* to the hour hand 17.

In order to realize the aforesaid two functions in the analog timepiece at the same time, a step motor has been used conventionally. The step motor, as is generally known, can rotate by a fixed angle. Further, as having holding energy, the step motor can hold the hands at original positions against a disturbance energy to some extent which is generated by an external impact.

In designing the step motor, a required holding energy is set first in accordance with hands to be used, and then driving conditions of the step motor are set based on the holding energy. The power consumption when the step motor is rotated is almost determined by the driving conditions thus set.

Accordingly, the driving conditions are not optimized only from the viewpoint of driving, and thus if performance of hand motion is all that is required, there is a possibility that even smaller driving energy causes step motion. However, the set value of the holding energy is decreased to the above end, bringing about a problem that the hands can not be held when the disturbance energy exceeds the holding energy which has been set at a small value.

Therefore, a holding energy larger than the disturbance energy which occurs at the hands due to an external impact is set to thereby prevent a handskip phenomenon in the conventional analog electronic timepiece.

The magnitude of the disturbance energy relates to the magnitude of inertia in consideration of imbalance caused by degree of unbalanced moment of the hands. Concerning hands, since the shape of the hand is restricted, the disturbance energy is greatly influenced by the magnitude of inertia. For instance, if hands are made larger or different in shape from what should be, giving priority to visual design, whereby the disturbance energy easily exceeds the holding energy. Consequently, a hand-skip phenomenon occurs, resulting in impossibility of implementation of the aforesaid two functions of the analog timepiece.

For the above reasons, giving priority to visual design requires setting a holding energy at a large value, thereby necessarily increasing the power consumption of the step motor.

DISCLOSURE OF THE INVENTION

The present invention is made in view of the above-described background, and its objects are to eliminate limitations from an aspect of functions of a timepiece on visual design of a hand in an analog electronic timepiece to thereby allow a visually freely designed hand to be used regardless of the magnitude of a moment of the hand and to reduce power consumption.

To achieve the above objects, the present invention is structured as follows in an analog electronic timepiece (a two-hand electronic timepiece) composed of an hour hand and a minute hand for indicating the time, a step motor for rotating the hour hand and the minute hand, and train wheels for decelerating the rotation of the step motor and transmitting it to the hour hand and the minute hand.

The timepiece is configured such that a semicircular addition member having a radius equal to that of a root circle of a center wheel gear is firmly fixed to a half part on the center wheel gear sharing a center wheel shaft with the minute hand and a center wheel pinion on the opposite side to a direction in which a time indicating part of the minute hand extends with respect to the center wheel shaft to reduce a moment on the center wheel shaft caused by a combination of a center wheel composed of the center wheel gear, the center wheel pinion, and the center wheel shaft and the minute hand.

Further, to achieve the above objects, the present invention is structured as follows also in an analog electronic timepiece (a three-hand electronic timepiece) composed of an hour hand, a minute hand, and a second hand for indicating the time, a step motor for rotating the hour hand, the minute hand, and the second hand, and train wheels for decelerating the rotation of the step motor and transmitting it to the hour hand, the minute hand, and the second hand.

The timepiece is configured such that a semicircular addition member having a radius equal to that of a root circle of a second wheel gear is firmly fixed to a half part on the second wheel gear sharing a second wheel shaft with the second hand and a second wheel pinion on the opposite side to a direction in which a time indicating part of the second hand extends with respect to the second wheel shaft to reduce a moment on the second wheel shaft caused by a combination of a second wheel composed of the second wheel gear, the second wheel pinion, and the second wheel shaft and the second hand.

Further, instead of the fixation of the addition member to the aforesaid center wheel gear or the second wheel gear, it is also suitable that the center wheel gear or the second wheel gear is made such that a half part thereof including a tooth form on the opposite side is thicker than a half part on the side of a direction in which a time indicating part of the minute hand or the second hand extends.

Alternatively, it is also suitable that the center wheel gear or the second wheel gear is made such that a half part thereof on the opposite side is larger in density of its material than a half part on the side of a direction in which a time indicating part of the minute hand or the second hand extends.

BEST MODE FOR CARRYING OUT THE INVENTION

Embodiments of this invention will be explained with reference to the drawings to describe this invention in more detail.

First embodiment

First, a first embodiment in which this invention is applied to an analog two-hand electronic timepiece will be explained with reference to FIG. 1 to FIG. 9.

Figure 1:
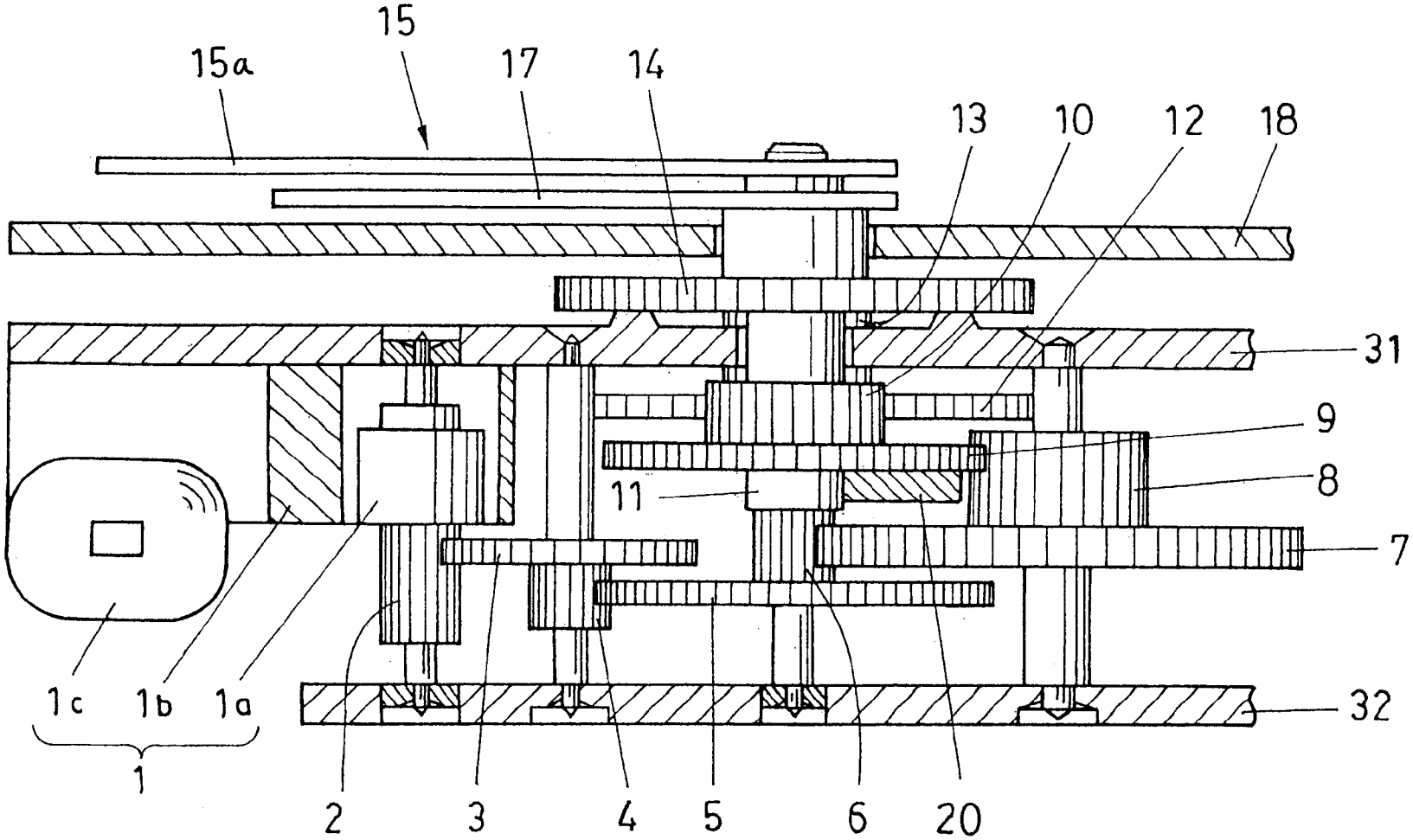
FIG. 1 is a sectional view of a driving part of an analog two-hand electronic timepiece according to a first embodiment of this invention.
Figure 19:
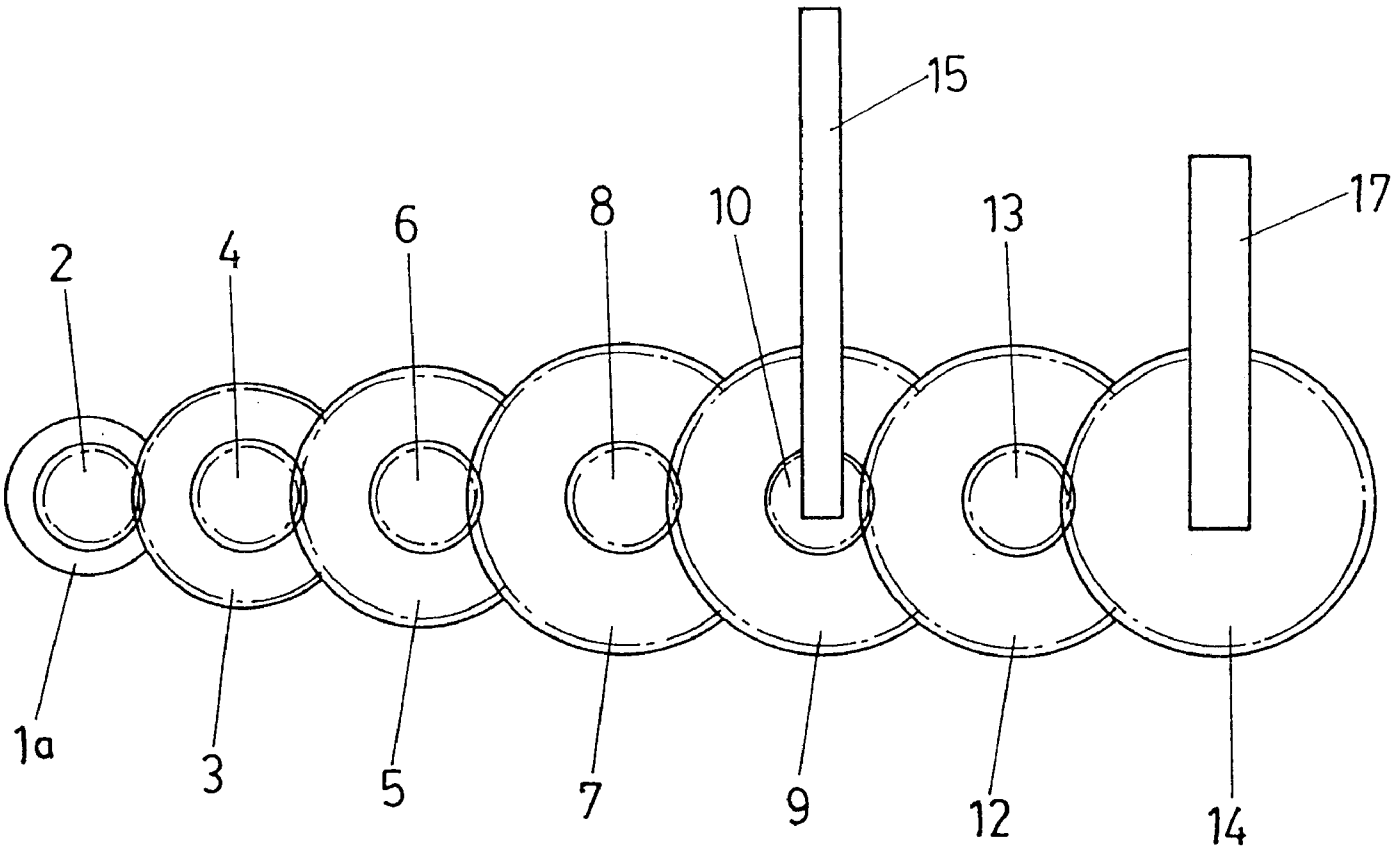
FIG. 19 PRIOR ART
FIG. 19 is an expanded view showing the structure of train wheels in a driving part of a conventional analog two-hand electronic timepiece.

FIG. 1 is a sectional view of a driving part of the analog two-hand electronic timepiece, its basic driving force transmitting mechanism being the same as that of the train wheel structure of the conventional example shown in FIG. 19, and the same numerals are given to parts corresponding to those in FIG. 19.

In FIG. 1, numeral 1 denotes a step motor, which is composed of a rotor 1*a*, a stator 1*b*, and a coil 1*c*, and the rotor 1*a* rotates 180° per second intermittently during its drive. The rotation of the rotor 1*a* is transmitted to a fifth wheel gear 3 engaging with a rotor pinion 2 to rotate a second wheel gear 5 via a fifth wheel pinion 4 which rotates integrally with the fifth wheel gear 3. The rotation of the second wheel gear 5 is transmitted to a third wheel gear 7 through a second wheel pinion 6 which rotates integrally with the second wheel gear 5, and further transmitted to a center wheel gear 9 engaging with a third wheel pinion 8 to rotate a center wheel shaft 11 which is a rotation shaft on which the center wheel gear 9 is firmly fixed and a minute hand 15 which is mounted on the tip of the center wheel shaft 11.

Further, the rotation of the center wheel gear 9 is transmitted to a minute wheel gear 12 engaging with a center wheel pinion 10 and transmitted through a minute wheel pinion 13 to an hour wheel 14, so that the rotation is transmitted to an hour hand 17 which is mounted on the tip of the hour wheel 14. The structure of the train wheels is not viewed from the hand side because of existence of an opaque dial 18. Incidentally, numeral 31 denotes a main plate and numeral 32 denotes a train wheel bridge. In the first embodiment, a semicircular addition member 20 serving as a weight is mounted on a half part of the under face of the center wheel gear 9 on the opposite side to a direction in which a time indicating part 15*a* (a long hand part extending to the left in FIG. 1) of the minute hand 15 extends with respect to the center wheel shaft 11.

Figure 2:
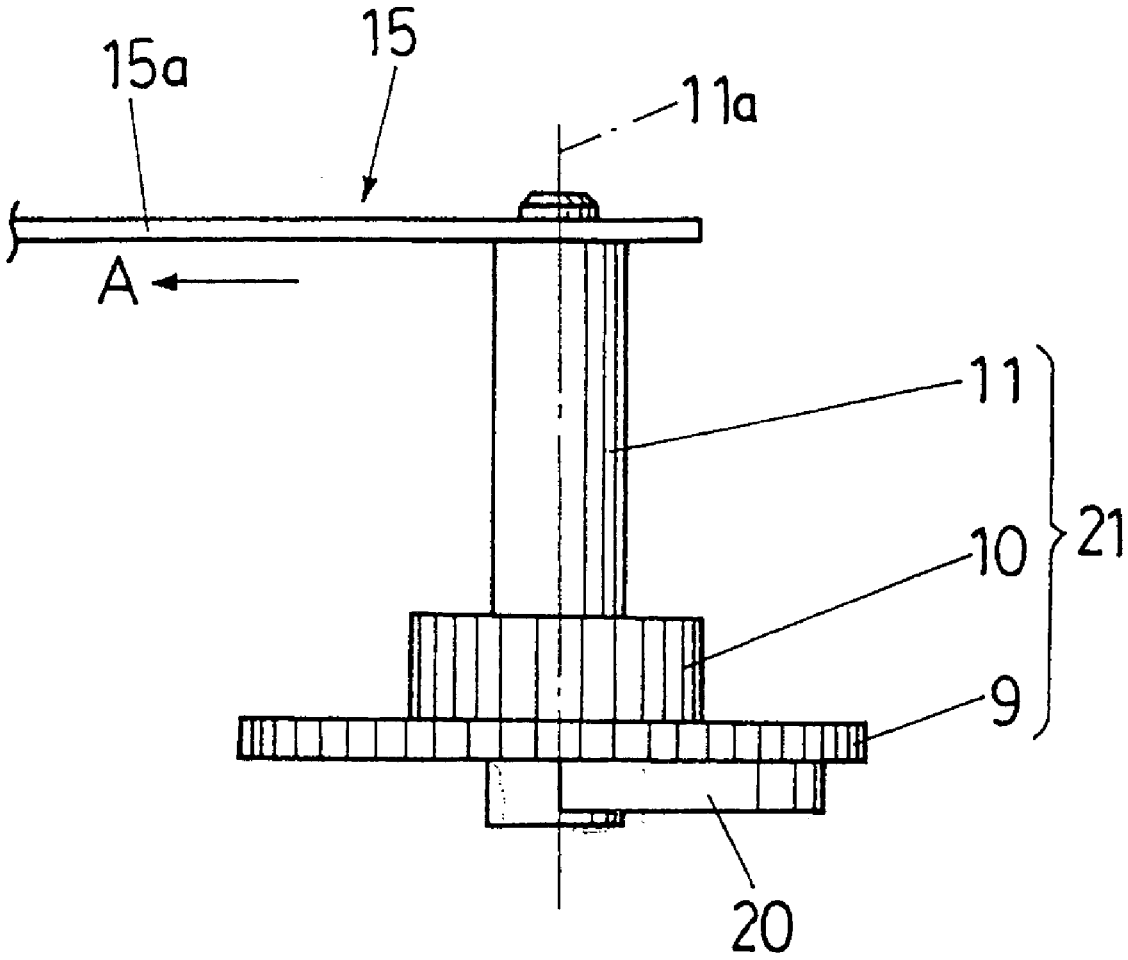
FIG. 2 is a front view showing the structure of a center wheel of the same.

FIG. 2 is a view showing the structure of a center wheel in this embodiment, in which the center wheel gear 9 is inserted in the center wheel shaft 11 integrated with the center wheel pinion 10 to be firmly fixed thereto, thereby forming a center wheel 21.

The minute hand 15 is mounted on the tip of the center wheel shaft 11 of the center wheel 21, and the semicircular addition member 20 is firmly fixed on the half part of the under face of the center wheel gear 9 on the opposite side to the direction in which the time indicating part 15*a* of the minute hand 15 extends with respect to the center wheel shaft 11.

Figure 3:
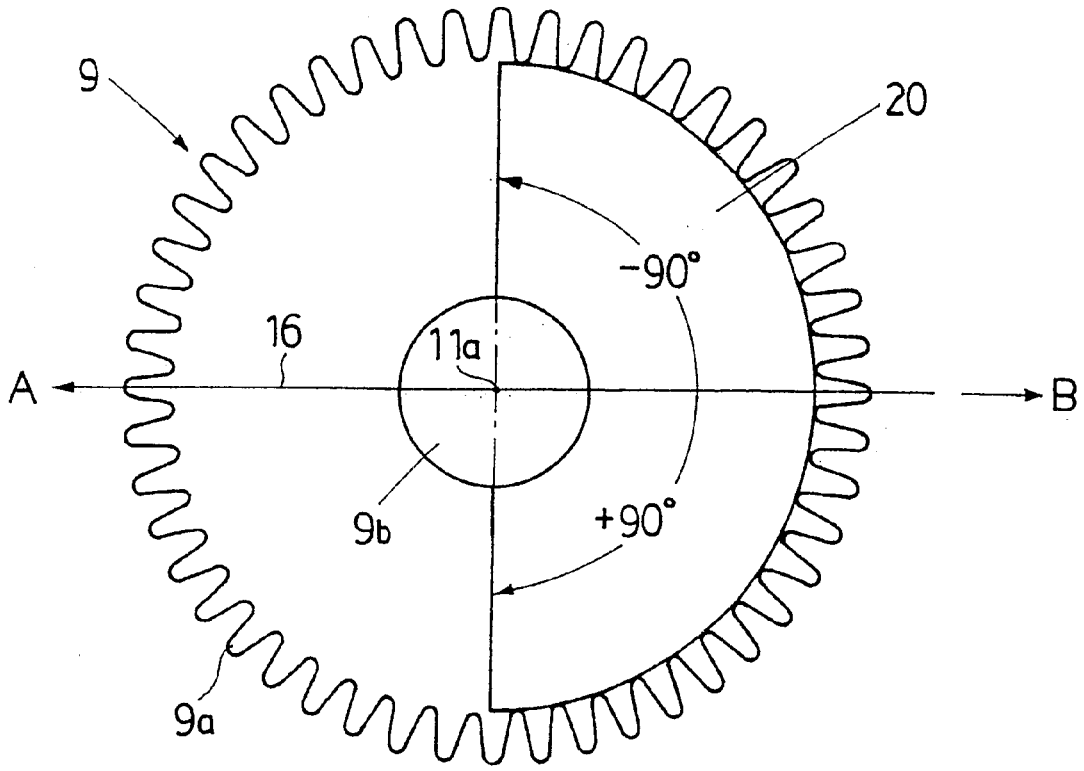
FIG. 3 and FIG. 4 are an under face view and a sectional view of a center wheel gear of the same on which an addition member is firmly fixed.
Figure 4:
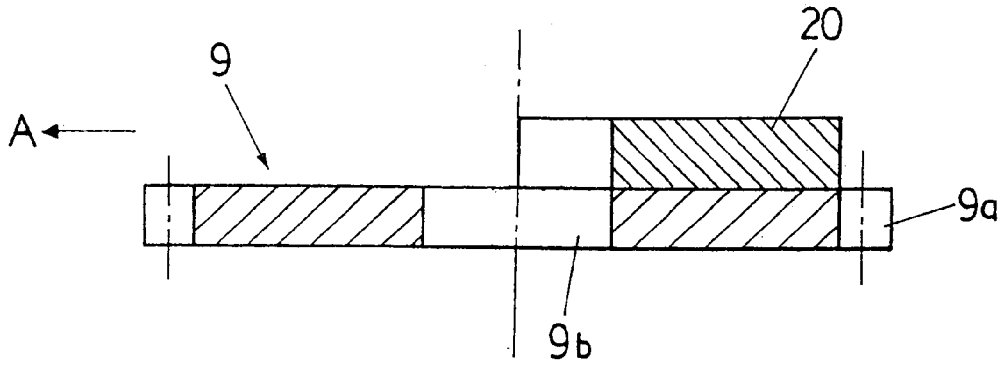

FIG. 3 is an under face view of the center wheel gear 9 and FIG. 4 is a sectional view thereof, showing the shape and the state of mounting of the addition member 20 in relation to the center wheel gear 9. The semicircular addition member 20 is firmly fixed on the right half part in FIG. 3 and FIG. 4 of the under face of the center wheel gear 9 but not on a tooth part 9*a* and a shaft hole 9*b* into which the center wheel shaft 11 is inserted.

A straight line with arrow 16 shown in FIG. 3 is a minute hand center line (a line linking the tip of the time indicating part 15*a* of the minute hand 15 and the rotation center) viewed from the top of FIG. 2, and the arrow A shows a direction in which the time indicating part 15*a* of the minute hand 15 extends. Further, the symmetry axis of the addition member 20 coincides with the minute hand center line 16.

The addition member 20 serving as a weight is mounted on the center wheel gear 9 to thereby displace (offset) the gravity center of the center wheel 21 shown in FIG. 2 from an axis 11*a* of the center wheel shaft 11 which is the rotation shaft thereof to within a range in the opposite direction to the direction A in which the time indicating part 15*a* of the minute hand 15 extends. This reduces a moment on the center wheel shaft 11 caused by a combination of the minute hand 15 and the center wheel 21.

As for the direction, the gravity center of the center wheel 21 is displaced from the center wheel shaft axis 11*a* (see FIG. 2) perpendicular to the paper to within an angle range of less than ±90° with respect to the opposite direction to the arrow A (a direction shown by the arrow B which is 180° opposite thereto) in which the time indicating part 15*a* of the minute hand 15 extends as shown in FIG. 3.

Displacement of the gravity center of the center wheel 21 to this range provides the effect of reducing the moment caused by the combination of the center wheel 21 and the minute hand 15, and the moment reduction effect becomes maximum when the gravity center is displaced in the direction (the direction of the arrow B) 180° opposite to the direction (the direction of the arrow A) in which the time indicating part 15*a* of the minute hand 15 extends.

The addition member 20 is a semicircular plate member as shown in FIG. 3, and the radius thereof is made not greater than the radius of the root circle of the center wheel gear 9 so as not to contact with the third wheel pinion 8 shown in FIG. 1.

The purpose of the addition member 20 is to reduce the moment caused by the combination of the center wheel 21 and the minute hand 15, and thus when the side of the time indicating part 15*a* of the minute hand 15 is heavy in weight, it is preferable that the radius of the addition member 20 is large, and the maximum effect is provided when it is equal to the radius of the root circle of the center wheel gear 9.

As a test example, the radius of the addition member 20 was made 1.19 mm. Further, the addition member 20 can be decreased in size by using a material with a high density, for example, tungsten or tantalum. In the test example, tungsten was employed for the addition member 20 and the thickness thereof was made 200 $\mu$m. It is needless to say that if there is extra space, the larger the thickness is, the greater the effect becomes.

This addition member 20 is mounted to the center wheel gear 9, thereby reducing the moment caused by the combination of the center wheel 21 and the minute hand 15.

The cause and effect relation of enabling reduction in power consumption by partially counterbalancing the moment of the minute hand is disclosed in detail in International Patent Laid Open WO98/30939 according to the invention by the present inventors.

More specifically, if "M" and "I" are set to satisfy the relation below, a hand-skip can be prevented:

$$M^2/I<2\times Ep/v^2$$

where a moment caused by the combination of the center wheel and the minute hand is "M", a minute hand equivalent inertial moment from the minute hand to the rotor of the step motor via the train wheels is "I", a speed of translational motion of the timepiece by receiving an external impact is "v", and a holding energy possessed by the step motor is "Ep".

The minute hand equivalent inertial moment here corresponds to the hand equivalent inertial moment explained in the aforesaid reference. This name is used since the minute hand is focused on in this embodiment.

Further, it has been shown, from the description disclosed in the aforesaid reference, that when a brass minute hand with a length of 6.1 mm and a moment of $6.5\times10^{-9}$ [kg•m] and a step motor with a holding energy of 150 nJ are used, a hand-skip occurs in a hammer shock test from a height of 30 cm.

The above minute hand has been conventionally used with a step motor having a holding energy of 330 nJ, but it becomes possible to prevent a hand-skip even through the use of a step motor with a small holding energy of 150 nJ which is the above-described holding energy since the moment "M" caused by the combination of the center wheel and the minute hand is decreased to thereby reduce the energy for rotating the minute hand which occurs upon an impact from the outside of the timepiece as the above-described relation.

It is apparent that the holding energy of the step motor is decreased to thereby reduce the driving energy for overcoming the holding energy to rotate the hand, resulting in reduced power consumption.

According to the test example fabricated this time, a correction moment by the addition member 20 was $-4.3\times10^{-9}$ [kg•m] (the minus sign means the direction of the moment being different), and the moment of the minute hand 15 was $6.5\times10^{-9}$ [kg•m], but the moment caused by the combination of the center wheel 21 and the minute hand 15, the sum of the correction moment and the minute hand moment, was reduced to $2.2\times10^{-9}$[kg•m].

On the minute hand 15 used in this test example, it is estimated that the absolute value of the moment caused by the combination of the center wheel 21 and the minute hand 15 is not greater than $4.0\times10^{-9}$ [kg•m] as the condition on the moment which does not cause a hand-skip in the hammer shock test from the height of 30 cm, and thus the aforesaid moment of $2.2\times10^{-9}$ [kg•m] sufficiently satisfies this condition.

When impacts from hammer heights of 30 cm were given by a hammer shock tester to the conventional timepiece and the timepiece of this embodiment, a hand-skip occurred in the conventional timepiece which has the same structure except for the absence of the addition member 20, but it did not occur in the timepiece of this embodiment on which the addition member 20 was mounted.

The inertial moment of the center wheel 21 increases to some extent by mounting the addition member 20 thereto, but reduction train wheels of 1/90 exist inbetween as viewed from the rotor 1*a* of the step motor 1, whereby influence by the increase in inertial moment of the center wheel 21 as viewed from the rotor 1*a* is reduced to one eight-thousand-one-hundredth. Therefore, the driving energy of the step motor hardly increases.

Further, nothing is added to the minute hand, bringing about no limitation to flexibility in visual design. Furthermore, the center wheel gear 9 and the addition member 20 never spoils the appearance since normally they are not viewed from the outside of the timepiece.

It should be noted that the addition member 20 shown in FIG. 3 is made in semicircular shape, but it is also suitable to mount an addition member in the form of fan with a center angle of less than 180° to be symmetric with respect to the minute hand center line 16.

Means as follows may be carried out as means for displacing the gravity center of the center wheel 21.

For example, the center wheel gear is changed in thickness along the minute hand center line 16 so that a half part thereof on the opposite side is thicker than a half part on the side of the direction in which the time indicating part 15*a* of the minute hand 15 extends.

Figure 5:
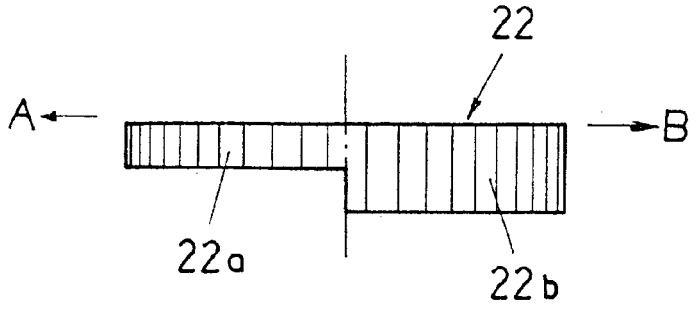
FIG. 5 and FIG. 6 are a front view and an under face view of a stepped center wheel gear.
Figure 6:
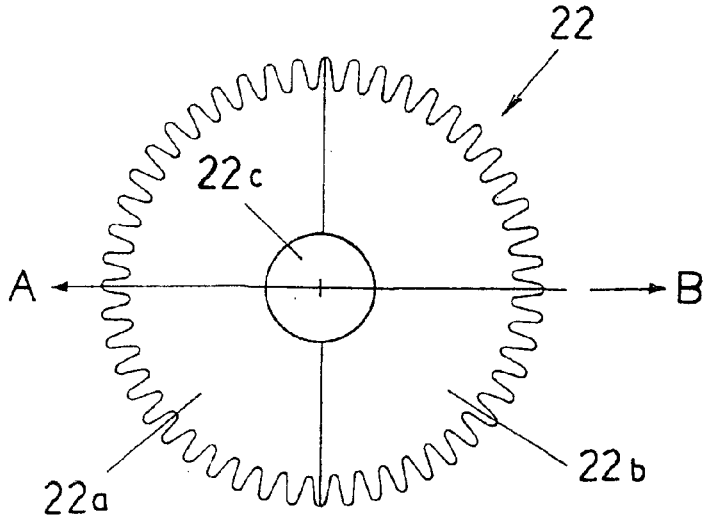

The example shown in FIG. 5 and FIG. 6 is realized with a stepped center wheel gear 22, in which a half part 22*b* on the. opposite arrow B direction side is made thicker than a half part 22*a* on the side of the arrow A direction in which the time indicating part 15*a* of the minute hand 15 extends with a boundary defined by a diameter line orthogonal to the minute hand center line 16, thereby providing a step. Numeral 22*c* in FIG. 6 denotes a shaft hole into which the center wheel shaft 11 is inserted.

Figure 7:
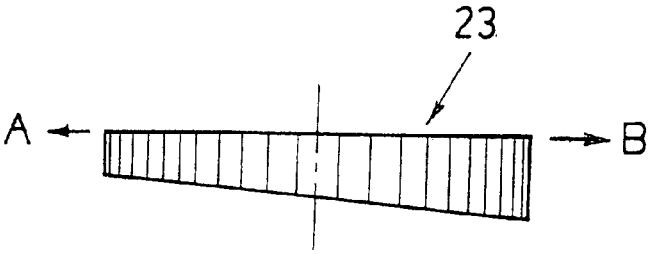
FIG. 7 is a front view of a wedge center wheel gear.

The example shown in FIG. 7, is an example using a wedge center wheel gear 23, which is in the form of wedge in the thickness direction, as a center wheel gear, and the wedge center wheel gear 23 increases in thickness without steps along the minute hand center line 16 in the arrow B direction.

Alternatively, though the illustration is omitted, it is also effective to form the center wheel gear out of materials which are different in density (mass) along the minute hand center line 16. For example, the materials of the center wheel gear are made different in density with a boundary defined by the diameter line orthogonal to the minute hand center line 16, so that a half part on the arrow B side is larger in density than a half part on the arrow A side.

Figure 8:
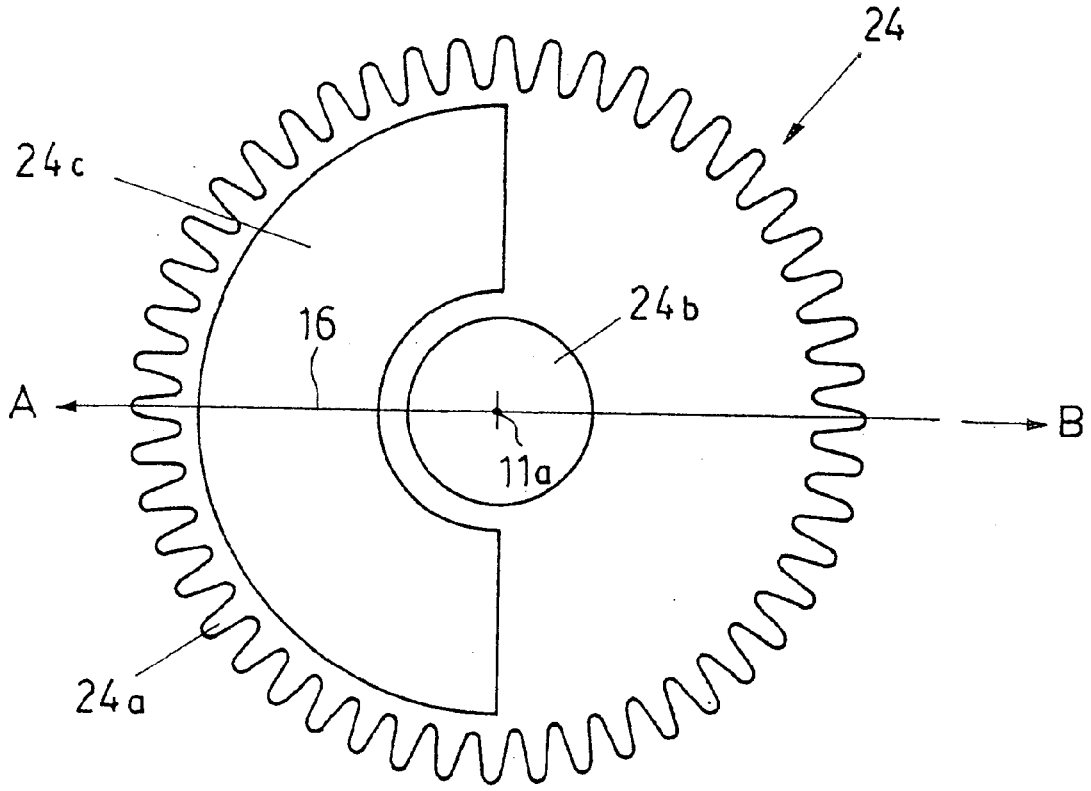
FIG. 8 and FIG. 9 are an under face view and a sectional view of a center wheel gear in which a hollow part is formed.
Figure 9:
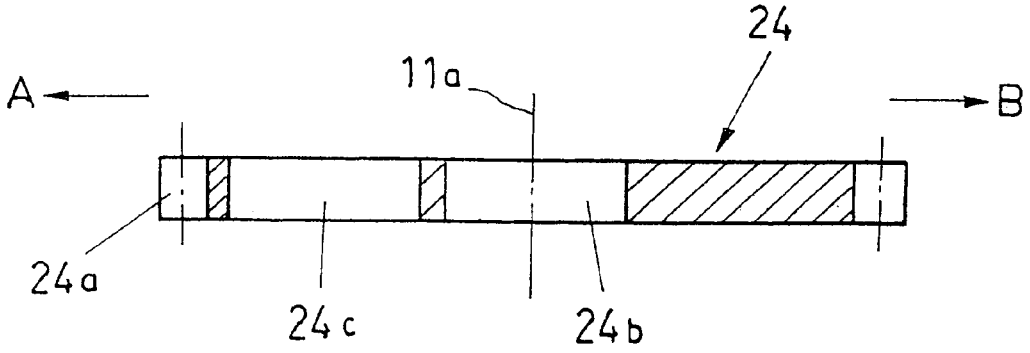

Moreover, it is also suitable to use a center wheel gear 24 in which a hollow part 24*c* is formed in a half part, with parts near a tooth part 24*a* and a shaft hole 24*b* left, on the side of the arrow A direction in which the time indicating part 15*a* of the minute hand 15 extends as shown in FIG. 8 and FIG. 9. Instead of the hollow part 24*c*, a thin wall part may be formed by cutting the center wheel gear 24 halfway in the thickness direction.

It is apparent that greater effects can be obtained by combining the above-described various .kinds of means, for example, by firmly fixing an addition member to a half part of the center wheel gear and forming a hollow part in the other half part thereof. Consequently, it is suitable to use a combination of necessary means depending on how much the moment on the center wheel shaft caused by a combination of the minute hand and the center wheel needs to be decreased.

The effectiveness of mounting an addition member to the center wheel and changing it in shape to prevent a hand-skip against an external impact when a minute hand for use is determined have been described in the above.

However, if a center wheel having a moment which is the same in magnitude as and different in direction from that of a standard minute hand is prepared as a standard item, a minute hand having a moment in a substantially wide range can satisfy the condition of not skipping against an external impact by being combined with the standard item of center wheel. Thus, it becomes possible that hands in various shapes are combined with the standard items of center wheel to form timepieces.

Further, center wheels which are gradually changed in moment are prepared for minute hands having large moments with which the standard items of center wheel can not cope so that a center wheel can be chosen for a minute hand desired to be used to prevent a hand-skip against an external impact.

As described above, the center wheels can cope with freely designed minute hands in gradual manner, thereby obtaining more preferable effects. Moreover, it is needless to say that preferable effects can be obtained also by combining a hand to which moment reduction is taken to some extent and the center wheel according to this invention.

It should be noted that when time adjustment of the minute hand 15 and the hour hand 17 shown in FIG. 1 is conducted, conventionally the center wheel gear 9 slips from the center wheel shaft 11 by receiving a large torque from a winding knob not shown to thereby enable the time adjustment. In the case in which the center wheel according to this invention is used, the center wheel gear 9 is changed in positional relation with respect to the center wheel shaft 11, bringing about a problem, but the center wheel gear 9 is firmly fixed to the center wheel shaft 11 and the third wheel gear 7 is made to slip from the axis, bringing about no problem.

Although the example in which four steps of reduction train wheels are formed from the rotor 1*a* of the step motor 1 to the center wheel gear 9 has been described in the embodiment shown in FIG. 1, the use of the center wheels comprising various kinds of center wheel gears as described above make it possible to reduce power consumption even with a structure of several steps of reduction train wheels other than the above.

Second embodiment

Next, a second embodiment in which this invention is applied to an analog three-hand electronic timepiece will be explained with reference to FIG. 10 to FIG. 18.

Figure 10:
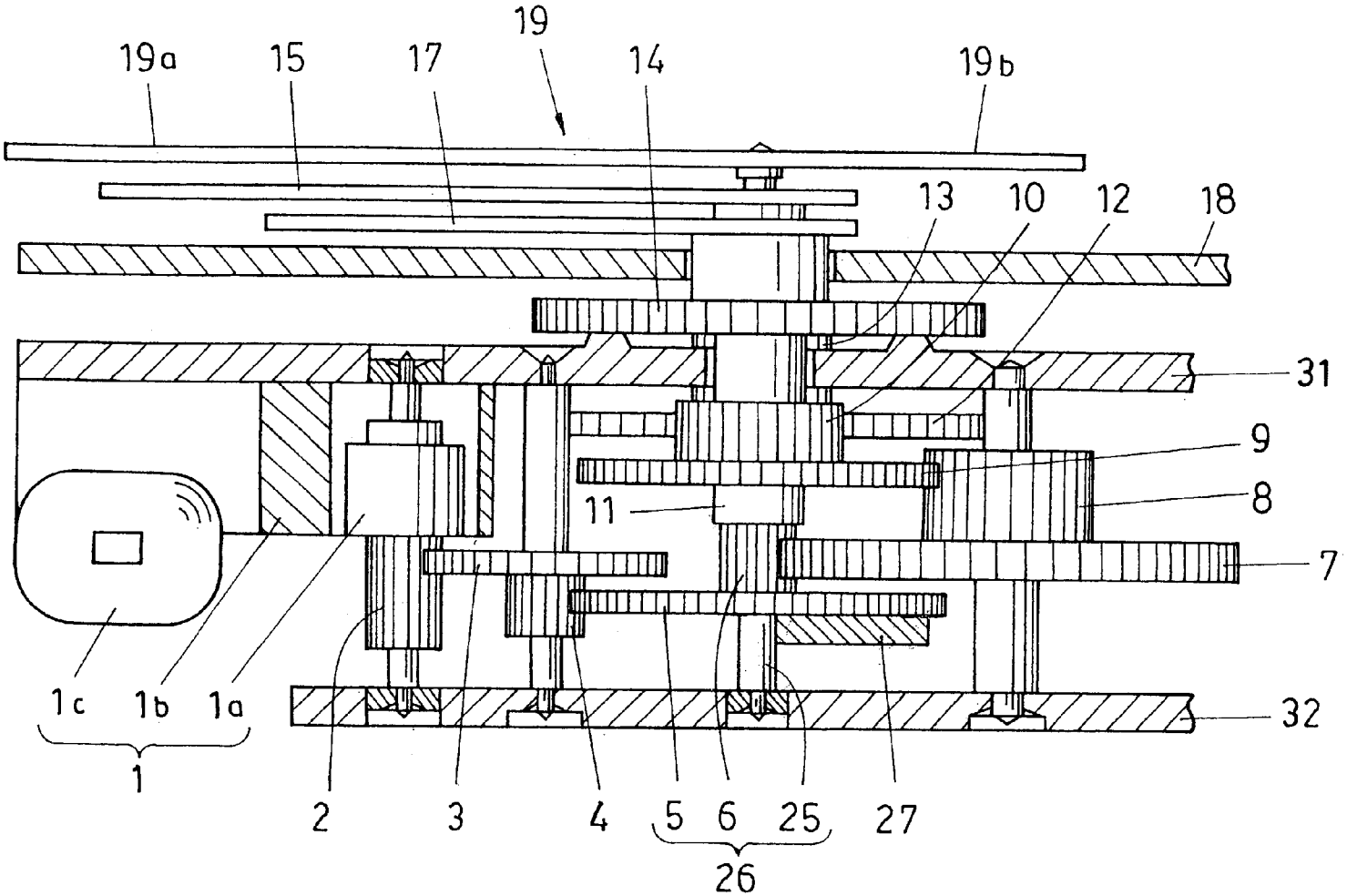
FIG. 10 is a sectional view of a driving part of an analog three-hand electronic timepiece according to a second embodiment of this invention.

FIG. 10 is a sectional view of a driving part of the analog three-hand electronic timepiece, and the same numerals are given to parts which are the same as those in FIG. 1.

In FIG. 10, when a rotor 1*a* of a step motor 1 rotates 180° per second intermittently, the rotation of the rotor 1*a* is transmitted to a fifth wheel gear 3 engaging with a rotor pinion 2 to rotate a second wheel gear 5 through a fifth wheel pinion 4 which rotates integrally with the fifth wheel gear 3.

The second wheel gear 5 rotates integrally with a second wheel pinion 6 and a second wheel shaft 25 to rotate a second hand 19 which is mounted on the tip of the second wheel shaft.

Further, the rotation of the second wheel shaft 25 is transmitted through the second wheel pinion 6 to a third wheel gear 7 and further transmitted to a center wheel gear 9 engaging with a third wheel pinion 8 to rotate a center wheel shaft 11 which is a rotation shaft on which the center wheel gear 9 is firmly fixed and a minute hand 15 mounted on the tip of the center wheel shaft 11.

Further, the rotation of the center wheel gear 9 is transmitted to a minute wheel gear 12 engaging with a center wheel pinion 10 and transmitted through a minute wheel pinion 13 to an hour wheel 14, so that the rotation is transmitted to an hour hand 17 which is mounted on the tip of the hour wheel 14. The structure of the train wheels is not viewed from the hand side because of existence of an opaque dial 18. Incidentally, numeral 31 denotes main plate and numeral 32 denotes a train wheel bridge.

In the second embodiment, a semicircular addition member 27 serving as a weight is mounted on a half part of the under face of the second wheel gear 5 on the opposite side (the side to which a tail part 19*b* of the second hand 19 extends) to a direction in which a time indicating part 19*a* (a long hand part extending to the left in FIG. 10) of the second hand 19 with respect to the second wheel shaft 25.

Figure 11:
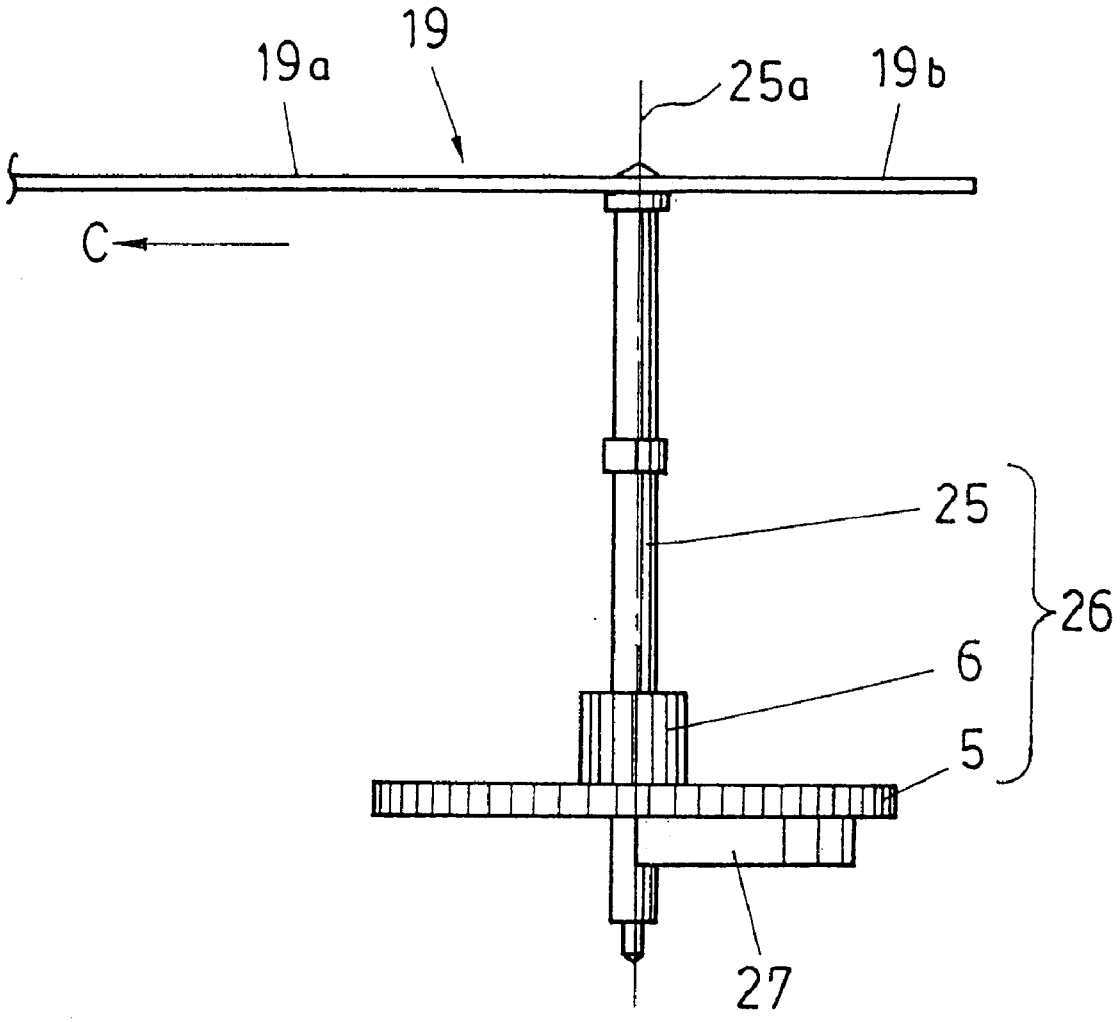
FIG. 11 is a front view showing the structure of a second wheel of the same.

FIG. 11 is a view showing the structure of a second wheel in this embodiment, in which the second wheel gear 5 is inserted in the second wheel shaft 25 integrated with the second wheel pinion 6 to be firmly fixed thereto, thereby forming a second wheel 26.

The second hand 19 is mounted on the tip of the second wheel shaft 25 of the second wheel 26, and the semicircular addition member 27 is firmly fixed on the half part of the under face of the second wheel gear 5 on the opposite side to the direction shown by the arrow C in which the time indicating part 19*a* of the second hand 19 extends with respect to the second wheel shaft 25.

Figure 12:
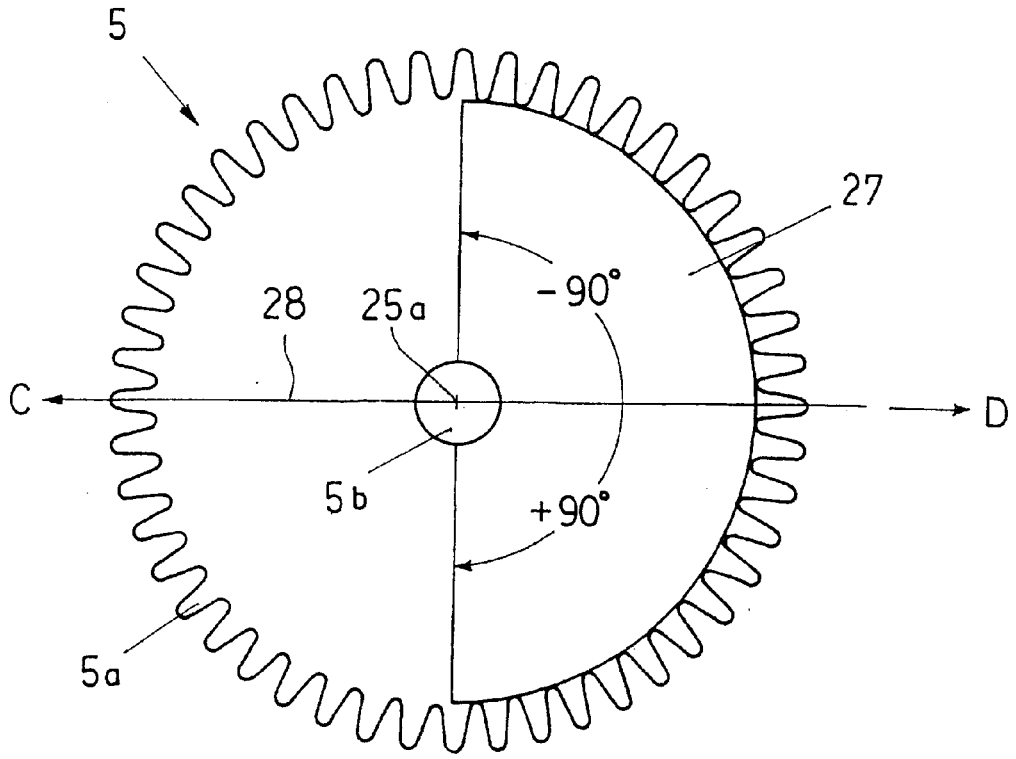
FIG. 12 and FIG. 13 are an under face view and a sectional view of a second wheel gear of the same on which an addition member is firmly fixed.
Figure 13:
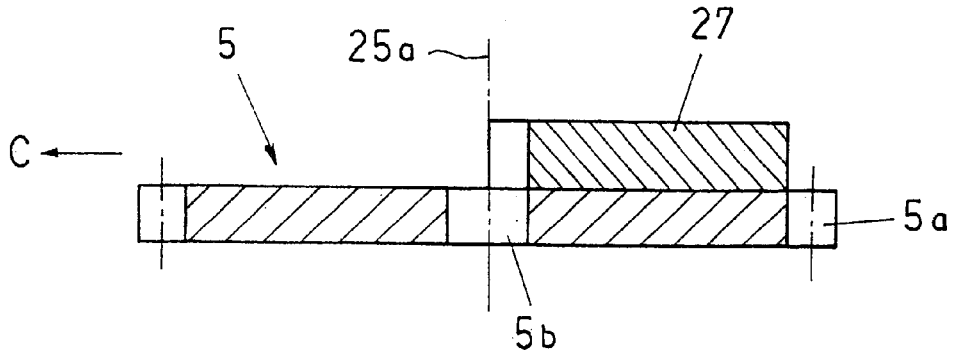

FIG. 12 is an under face view of the second wheel gear 5 and FIG. 13 is a sectional view thereof, showing the shape and the state of mounting the addition member 27 in relation to the second wheel gear 5. The semicircular addition member 27 is firmly fixed on the right half part in FIG. 12 and FIG. 13 of the under face of the second wheel gear 5 but not on a tooth part 5*a* and a shaft hole 5*b* into which the second wheel shaft 25 is inserted.

A straight line with arrow 28 shown in FIG. 12 is a second hand center line (a line linking the tip of the time indicating part 19*a* of the second hand 19 and the rotation center thereof) viewed from the top of FIG. 11, and the arrow C shows the direction in which the time indicating part 19*a* of the second hand 19 extends. Further, the symmetry axis of the addition member 27 coincides with the second hand center line 28.

The addition member 27 serving as a weight is mounted on the second wheel gear 5 to thereby displace (offset) the gravity center of the second wheel 26 shown in FIG. 11 from an axis 25*a* of the second wheel shaft 25 which is the rotation shaft thereof to within a range in the opposite direction to the direction C in which the time indicating part 19*a* of the second hand 19 extends. This reduces a moment on the second wheel shaft 25 caused by a combination of the second hand 19 and the second wheel 26.

As for the direction, the gravity center of the second wheel 26 is displaced from the second wheel shaft axis 25*a* (see also FIG. 11) perpendicular to the paper to within an angle range of less than ±90° with respect to the opposite direction to the arrow C (a direction shown by the arrow D which is 180° opposite thereto) in which the time indicating part 19*a* of the second hand 19 extends as shown in FIG. 12.

Displacement of the gravity center of the second wheel 26 to this range provides the effect of reducing the moment caused by the combination of the second wheel 26 and the second hand 19, and the moment reduction effect becomes maximum when the gravity center is displaced in the direction (the direction of the arrow D) 180° opposite to the direction (the direction of the arrow C) in which the time indicating part 19*a* of the second hand 19 extends.

The addition member 27 is a semicircular plate member as shown in FIG. 12, and the radius thereof is made not greater than the radius of the root circle of the second wheel gear 5 so as not to contact with the fifth wheel pinion 4 shown in FIG. 10.

The purpose of the addition member 27 is to reduce the moment caused by the combination of the second wheel 26 and the second hand 19, and thus when the side of the time indicating part 19*a* of the second hand 19 is heavy in weight, it is preferable that the radius of the addition member 27 is large, and the maximum effect is provided when it is equal to the radius of the root circle of the second wheel gear 5.

As a test example, the radius of the addition member 27 was made 1.17 mm. Further, the addition member 27 can be decreased in size by using a material with a high density, for example, tungsten or tantalum. In the test example, tungsten was employed for the addition member 27, and the thickness thereof was made 100 $\mu$m. It is needless to say that if there is extra space, the larger the thickness is, the greater the effect becomes.

The addition member 27 is mounted to the second wheel gear 5, thereby reducing the moment caused by the combination of the second wheel 26 and the second hand 19.

The cause and effect relation of enabling reduction in power consumption by partially counterbalancing the moment of the second hand is also disclosed in detail in the above-described International Patent Laid Open W098/30939.

More specifically, if "M" and "I" are set to satisfy the relation below, a hand-skip can be prevented:

$$M^2/I<2\times Ep/v^2$$

where a moment caused by the combination of the second wheel and the second hand is "M", a second hand equivalent inertial moment from the second hand to the rotor of the step motor via the train wheels is "I", a speed of translational motion of the timepiece by receiving an external impact is "v", and a holding energy possessed by the step motor is "Ep".

The second hand equivalent inertial moment here corresponds to the hand equivalent inertial moment explained in the aforesaid reference. This name is used since the second hand is focused on in this embodiment.

Further, it has been shown, from the description disclosed in the aforesaid reference, that when a second hand with a length of 13.5 mm and a moment of $2.7\times10^{-9}$ [kg•m] and a step motor with a holding energy of 154 nJ are used, a hand-skip occurs in a hammer shock test from a height of 30 cm. It has also been shown that it is sufficient to reduce the moment caused by the combination of the second wheel and the second hand by about 10% to prevent a hand-skip in this timepiece.

The above second hand has been conventionally used with a step motor having a holding energy of 334 nJ, but it becomes possible to prevent a hand-skip even through the use of a step motor with a small holding energy of 154 nJ which is the above-described holding energy since the moment "M" caused by the combination of the second wheel and the second hand is decreased to thereby reduce the energy for rotating the second hand which occurs upon an impact from the outside of the timepiece as the above-described relation.

It is apparent that the holding energy of the step motor is decreased to thereby reduce the driving energy for overcoming the holding energy to rotate the second hand, resulting in reduced power consumption of the step motor.

According to the test example fabricated this time, a correction moment by the addition member 27 was $-2.0\times10^{-9}$ [kg•m] (the minus sign means the direction of the moment being different), and when the moment of the second hand 19 was $2.7\times10^{-9}$ [kg•m], the moment caused by the combination of the second wheel 26 and the second hand 19, the sum of the correction moment and the second hand moment, was reduced to $0.7\times10^{-9}$ [kg•m].

On the second hand 19 used in this embodiment, it is estimated that the absolute value of the moment caused by the combination of the second wheel 26 and the second hand 19 is not greater than $2.4\times10^{-9}$[kg•m] as the condition on the moment which does not cause a hand-skip in the hammer shock test from the height of 30 cm, and thus the aforesaid moment of $0.7\times10^{-9}$ [kg•m] sufficiently satisfies this condition.

When impacts from hammer heights of 30 cm were given by a hammer shock tester to the conventional timepiece and the timepiece of this embodiment, a hand-skip occurred in the conventional timepiece which has the same structure except for the absence of the addition member 27, but it did not occur in the timepiece of this embodiment on which the addition member 27 was mounted.

From the viewpoint of influence on driving, the inertial moment of the second wheel 26 increases to some extent by mounting the addition member 27, but reduction train wheels exist inbetween as viewed from the rotor 1*a* of the step motor 1, whereby the influence by the increase in inertial moment of the second wheel 26 as viewed from the rotor 1*a* is reduced to one nine-hundredth. Therefore, the driving energy of the step motor hardly increases.

It should be noted that the addition member 27 shown in FIG. 12 is made in semicircular shape, but it is also suitable to mount an addition member in the form of fan with a center angle of less than 180° to be symmetric with respect to the second hand center line 28.

Means as follows may be carried out as means for displacing the gravity center of the second wheel 26.

For example, the second wheel gear is changed in thickness along the second hand center line 28 so that a half part thereof on the opposite side is thicker than a half part on the side of the direction in which the time indicating part 19*a* of the second hand 19 extends.

Figure 14:
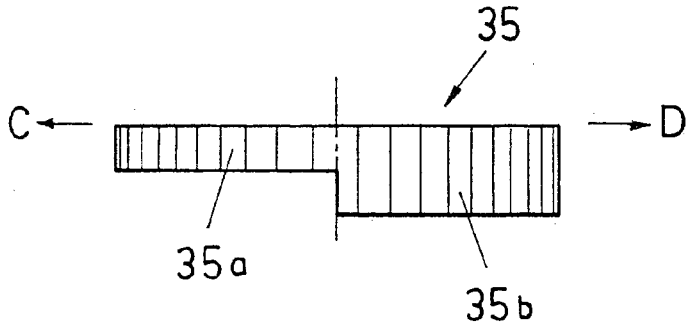
FIG. 14 and FIG. 15 are a front view and an under face view of a stepped second wheel gear.
Figure 15:
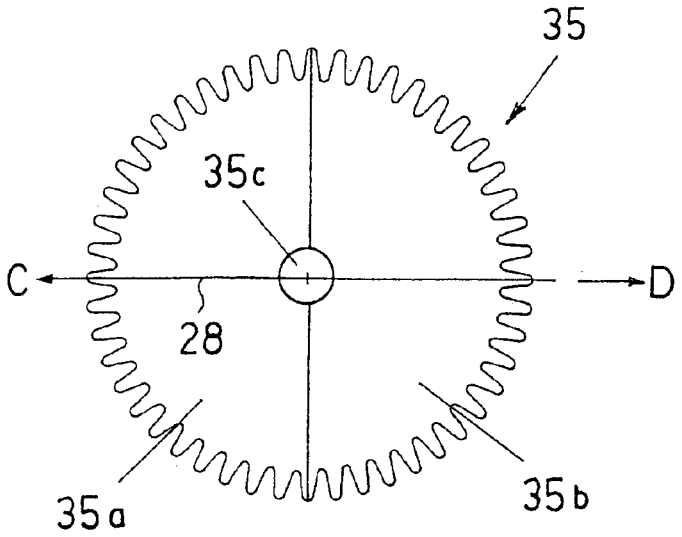

The example shown in FIG. 14 and FIG. 15 is realized with a stepped second wheel gear 35, in which a half part 35*b* on the opposite arrow D direction side is made thicker than a half part 35*a* on the side of the arrow C direction in which the time indicating part 19*a* of the second hand 19 extends with a boundary defined by a diameter line orthogonal to the second hand center line 28, thereby providing a step. Numeral 35*c* in FIG. 15 denotes a shaft hole into which the second wheel shaft 25 is inserted.

As a concrete example of fabrication, the stepped second wheel gear 35 shown in FIG. 14 was fabricated of brass, as a material, such that the thickness of the thin half part 35*a* was 100 $\mu$m and that of the thick half part was 200 $\mu$m. In this case, the correction moment by the stepped second wheel gear 35 was $-1.1\times10^{-9}$ [kg•m], and when the moment of the second hand 19 was $2.7\times10^{-9}$ [kg•m], the moment caused by the combination of the second wheel and the second hand, the sum thereof, was reduced to $1.6\times10^{-9}$ [kg•m].

This value satisfies the above-described condition on the moment which does not cause a hand-skip. Further, a hand-skip did not occur in the hammer shock test from the height of 30 cm.

Figure 16:
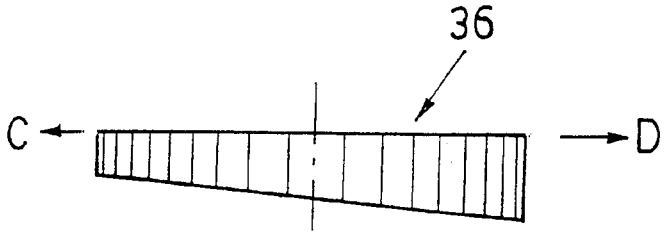
FIG. 16 is a front view of a wedge second wheel gear.

The example shown in FIG. 16 is an example using a wedge second wheel gear 36, which is in the form of wedge in the thickness direction, as a second wheel gear, and the wedge second wheel gear 36 increases in thickness without steps along the second hand center line 28 in the arrow C direction.

As a concrete example of fabrication in this case, the wedge second wheel gear 36 was fabricated of brass to be 200 $\mu$m at the thickest part and 100 $\mu$m at the thinnest part.

Thus, the correction moment by the wedge second wheel gear 36 was $-0.3\times10^{-9}$ [kg•m], and when the moment of the second hand 19 was $2.7\times10^{-9}$ [kg•m], the moment caused by the combination of the second wheel and the second hand, the sum thereof, was reduced to $2.4\times10^{-9}$ [kg•m].

Alternatively, though the illustration is omitted, it is also effective to form the second wheel gear out of materials which are different in density (mass) along the second hand center line 28. For example, the materials of the second wheel gear are made different in density with a boundary defined by the diameter line orthogonal to the second hand center line 28, so that a half part on the arrow D side is larger in density than a half part on the arrow C side.

Figure 17:
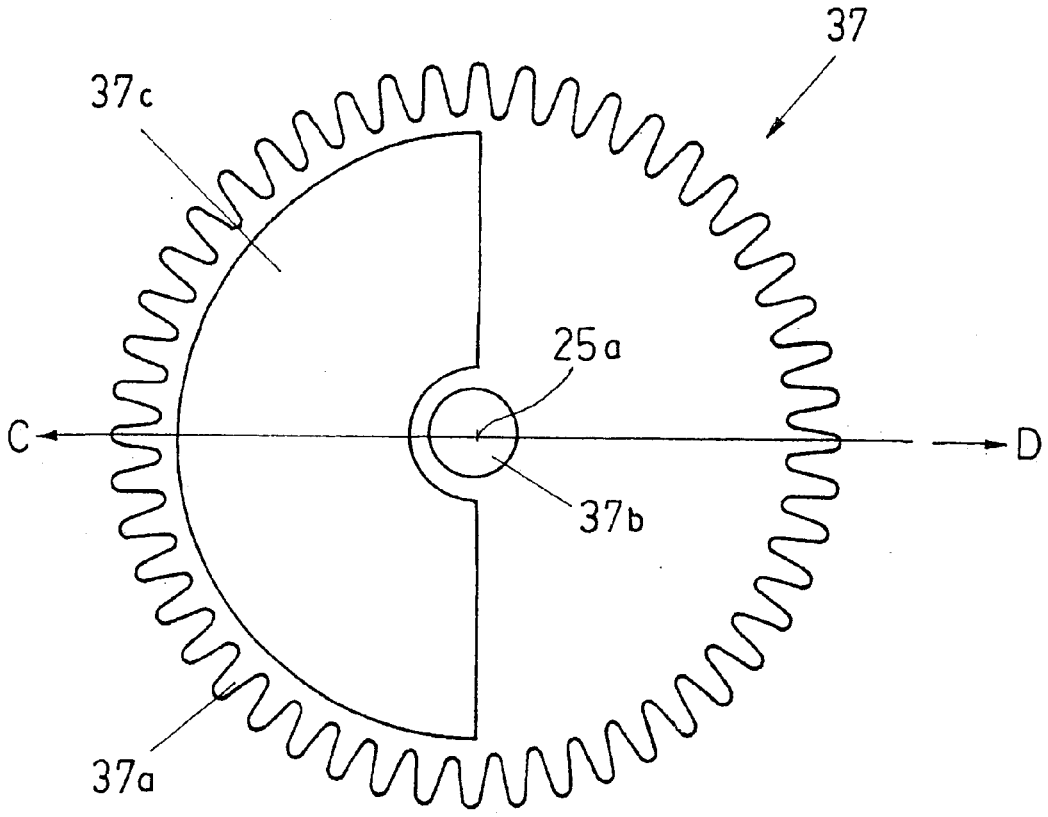
FIG. 17 and FIG. 18 are an under face view and a sectional view of a second wheel gear in which a hollow part is formed.
Figure 18:
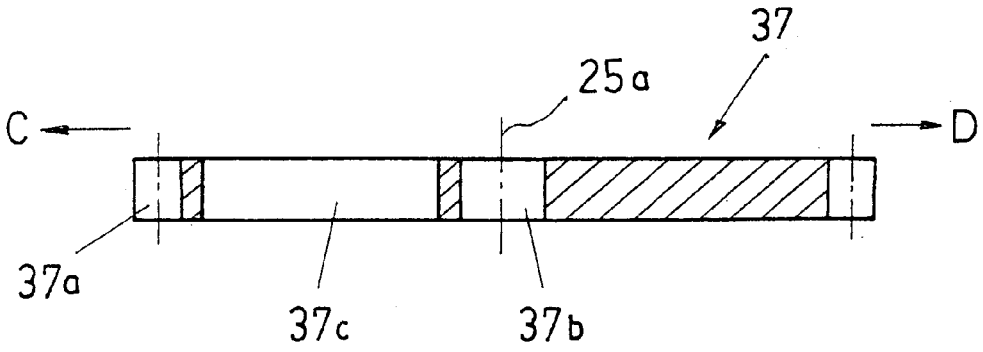

Moreover, it is also suitable to use a second wheel gear 37 in which a hollow part 37*c* is formed in a half part, with parts near a tooth part 37*a* and a shaft hole 37*b* left, on the side of the arrow C direction in which the time indicating part 19*a* of the second hand 19 extends as shown in FIG. 17 and FIG. 18. Instead of the hollow part 37*c*, a thin wall part may be formed by cutting the second wheel gear 37 halfway in the thickness direction.

As a concrete example of fabrication in this case, in consideration of the strength of the tooth part 37*a*, the radius of the hollow part 37*c* was made 970 $\mu$m so as to leave 200 $\mu$m even at the thinnest part. The second wheel gear 37 is made 100 $\mu$m in thickness and out of brass.

In this event, the correction moment by the hollow part 37*c* of the second wheel gear 37 was $-0.5\times10^{-9}$ [kg•m], and when the moment of the second hand 19 was $2.7\times10^{-9}$ [kg•m], the moment caused by the combination of the second wheel and the second hand 19 could be reduced to $2.2\times10^{-9}$ [kg•m]. This also satisfies the above-described condition on the moment which does not cause a hand-skip.

It is apparent that greater effects can be obtained by combining the above-described various kinds of means, for example, by firmly fixing an addition member to a half part of the second wheel gear and forming a hollow part in the other half part thereof. Consequently, it is suitable to use a combination of necessary means depending on how much the moment on the second wheel shaft caused by a combination of the second hand and the second wheel needs to be decreased.

Also in this analog three-hand electronic timepiece, if a second wheel having a moment which is the same in magnitude as and different in direction from that of a standard second hand is prepared as a standard item, a second hand having a moment in a substantially wide range satisfies the condition of not skipping against an external impact for the standard item, and thus it becomes possible that the second hand is combined with the standard item of second wheel to form a timepiece.

Further, second wheels which are gradually changed in moment are prepared for second hands having large moments with which the standard items of second wheel can not cope so that a second wheel can be chosen for a second hand desired to be used to prevent a hand-skip against an external impact.

As described above, the second wheels can cope with freely designed second hands in gradual manner, thereby obtaining more preferable effects. Moreover, it is needless to say that preferable effects can be obtained also by combining a second hand to which moment reduction is taken to some extent and the second wheel according to this invention.

Although two steps of reduction train wheels are formed from the rotor 1*a* of the step motor 1 to the second wheel gear 5 in this embodiment, the use of the aforesaid second wheel makes it possible to reduce power consumption even with a train structure in which the rotor and the second wheel gear are directly engaged each other or even if two or more steps of reduction train wheels exist from the rotor to the second wheel gear.

INDUSTRIAL APPLICABILITY

As has been described, the gravity center of the center wheel including the center wheel gear or the second wheel including the second wheel gear is displaced from the axis of the center wheel shaft or the second wheel shaft with respect to the minute hand or the second hand which has a large moment, whereby the analog electronic timepiece according to the present invention can be reduced in moment on the rotation shaft caused by a combination of the wheel and the minute hand or the second hand.

Therefore, the disturbance energy rotating the minute hand or the second hand, which is generated when an external impact is given from the outside of the timepiece, can be reduced, with the result that a hand-skip does not occur even if the holding energy value in the step motor is decreased.

Consequently, power consumption of the step motor can be reduced, making it possible to reduce power consumption of the electronic timepiece. Moreover, since there arise no limitations on visual design for the minute hand and the second hand, a minute hand and a second hand which are freely designed in appearance can be used, resulting in diversification of the analog electronic timepiece.

What is claimed is:

1. An analog electronic timepiece comprising a hour hand and a minute hand for indicating the time, a step motor for rotating said hour hand and said minute hand, and train wheels for decelerating the rotation of said step motor and transmitting it to said hour hand and said minute hand, wherein a semicircular addition member having a radius equal to that of a root circle of a center wheel gear is firmly fixed to a half part on said center wheel gear sharing a center wheel shaft with said minute hand and a center wheel pinion on the opposite side to a direction in which a time indicating part of said minute hand extends with respect to said center wheel shaft to reduce a moment on said center wheel shaft caused by a combination of a center wheel composed of said center wheel gear, said center wheel pinion, and said center wheel shaft and said minute hand.

2. The analog electronic timepiece according to claim 1, wherein said addition member is firmly fixed on a face of said center wheel gear on the opposite side to the side on which said center wheel pinion is provided.

3. The analog electronic timepiece according to claim 1, wherein a hollow part is formed in a half part of said center wheel gear on the side of the direction in which the time indicating part of said minute hand extends with respect to said center wheel shaft.

4. The analog electronic timepiece according to claim 1, wherein said addition member is made of tungsten or tantalum.

5. An analog electronic timepiece comprising a hour hand, a minute hand, and a second hand for indicating the time, a step motor for rotating said hour hand, said minute hand, and said second hand, and train wheels for decelerating the rotation of said step motor and transmitting it to said hour hand, said minute hand, and said second hand, wherein a semicircular addition member having a radius equal to that of a root circle of a second wheel gear is firmly fixed to a half part on said second wheel gear sharing a second wheel with said second hand and a second wheel pinion on the opposite side to a direction in which a time indicating part of said second hand extends with respect to said second wheel shaft to reduce a moment on said second wheel shaft caused by a combination of a second wheel composed of said second wheel gear, said second wheel pinion, and said second wheel shaft and said second hand.

6. The analog electronic timepiece according to claim 5, wherein said addition member is firmly fixed on a face of said second wheel gear on the opposite side to the side on which said second wheel pinion is provided.

7. The analog electronic timepiece according to claim 5, wherein a hollow part is formed in a half part of said second wheel gear on the side of the direction in which the time indicating part of said second hand extends with respect to said second wheel shaft.

8. The analog electronic timepiece according to claim 5, wherein said addition member is made of tungsten or tantalum.

9. An analog electronic timepiece comprising a hour hand and a minute hand for indicating the time, a step motor for rotating said hour hand and said minute hand, and train wheels for decelerating the rotation of said step motor and transmitting it to said hour hand and said minute hand, wherein a center wheel gear sharing a center wheel shaft in common with said minute hand and a center wheel pinion is made such that a half part thereof including a tooth form on the opposite side is thicker than a half part on the side of a direction in which a time indicating part of said minute hand extends with respect to said center wheel shaft to reduce a moment on said center wheel shaft caused by a combination of a center wheel composed of said center wheel gear, said center wheel pinion, and said center wheel shaft and said minute hand.

10. An analog electronic timepiece comprising a hour hand, a minute hand, and a second hand for indicating the time, a step motor for rotating said hour hand, said minute hand, and said second hand, and train wheels for decelerating the rotation of said step motor and transmitting it to said hour hand, said minute hand, and said second hand, wherein a second wheel gear sharing a second wheel shaft in common with said second hand and a second wheel pinion is made such that a half part thereof including a tooth form on the opposite side is thicker than a half part on the side of a direction in which a time indicating part of said second hand extends with respect to said second wheel shaft to reduce a moment on said second wheel shaft caused by a combination of a second wheel composed of said second wheel gear, said second wheel pinion, and said second wheel shaft and said second hand.

11. An analog electronic timepiece comprising a hour hand and a minute hand for indicating the time, a step motor for rotating said hour hand and said minute hand, and train wheels for decelerating the rotation of said step motor and transmitting it to said hour hand and said minute hand, wherein a center wheel gear sharing a center wheel shaft in common with said minute hand and a center wheel pinion is made such that a half part thereof on an opposite side is larger in density of its material than a half part on a side of a direction in which a time indicating part of said minute hand extends with respect to said center wheel shaft to reduce a moment on said center wheel shaft caused by a combination of a center wheel composed of said center wheel gear, said center wheel pinion, and said center wheel shaft and said minute hand.

12. An analog electronic timepiece comprising a hour hand, a minute hand, and a second hand for indicating the time, a step motor for rotating said hour hand, said minute hand, and said second hand, and train wheels for decelerating the rotation of said step motor and transmitting it to said hour hand, said minute hand, and said second hand, wherein a second wheel gear sharing a second wheel shaft in common with said second hand and a second wheel pinion is made such that a half part thereof on an opposite side is larger in density of its material than a half part on a side of a direction in which a time indicating part of said second hand extends with respect to said second wheel shaft to reduce a moment on said second wheel shaft caused by a combination of a second wheel composed of said second wheel gear, said second wheel pinion, and said second wheel shaft and said second hand.

* * * * *